US011713208B1

(12) United States Patent
Gold

(10) Patent No.: US 11,713,208 B1
(45) Date of Patent: Aug. 1, 2023

(54) CODE ABSORBING MARKING OF PAPER REAMS

(71) Applicant: Peter Gold, Rockville Center, NY (US)

(72) Inventor: Peter Gold, Rockville Center, NY (US)

( * ) Notice: Subject to any disclaimer, the term of this patent is extended or adjusted under 35 U.S.C. 154(b) by 0 days.

(21) Appl. No.: 17/887,929

(22) Filed: Aug. 15, 2022

(51) Int. Cl.
*B65H 45/04* (2006.01)

(52) U.S. Cl.
CPC ..... *B65H 45/04* (2013.01)

(58) Field of Classification Search
CPC ..... B65H 45/04; B65H 45/06; B65H 45/09; B65H 45/10; B65H 45/12; B65H 45/14; B65H 45/22; B31F 1/2804
USPC ..... 493/405
See application file for complete search history.

(56) References Cited

U.S. PATENT DOCUMENTS 4,944,450 A * 7/1990 Schmidt ..... B42D 15/08 229/92.7
4,981,251 A * 1/1991 Jenkins ..... B65D 27/04 229/72
5,085,417 A * 2/1992 Copham ..... B42D 15/00 270/58.08
5,288,015 A * 2/1994 Sauerwine ..... B42D 5/026 229/300
5,366,410 A * 11/1994 Lombardo ..... B42D 15/08 462/64
5,472,240 A * 12/1995 Davies ..... B42D 15/042 283/67
6,126,064 A * 10/2000 Hutchinson ..... B42D 15/08 283/105
6,330,976 B1 * 12/2001 Dymetman ..... H04N 1/32042 235/487
6,478,337 B1 * 11/2002 Toda ..... B42F 21/00 283/42
6,585,163 B1 * 7/2003 Meunier ..... G06K 19/06028 235/487
7,649,659 B2 * 1/2010 Nabemoto ..... H04N 1/00708 358/1.18
7,857,442 B2 * 12/2010 Rabbani ..... B41J 2/17593 347/101
8,411,312 B2 * 4/2013 Kanzawa ..... B42D 1/009 399/382
8,418,879 B2 * 4/2013 Sherman ..... A47K 10/42 221/48
8,570,595 B2 * 10/2013 Nagakoshi ..... H04N 1/0044 358/448
8,616,434 B2 * 12/2013 Wilen ..... B42D 5/025 229/92.1
8,915,187 B2 * 12/2014 Horn ..... G03G 15/00 101/485
10,289,874 B2 * 5/2019 Smith ..... G06K 1/121
(Continued)

FOREIGN PATENT DOCUMENTS

EP 2177361 A1 * 4/2010 ..... B41J 2/17593
EP 3705429 A4 * 7/2021 ..... B65H 29/52

*Primary Examiner* — Sameh Tawfik
(74) *Attorney, Agent, or Firm* — Schwegman Lundberg & Woessner, P.A.

(57) ABSTRACT

A process includes coding or marking a first side of a ream of paper such that a first mark appears on an edge of each sheet of paper of the ream of paper. This coding or marking results in the first mark absorbing onto a top surface and a bottom surface of each sheet of paper of the ream of paper. The coding or marking can either convey information or serve a function such as assisting in folding a sheet of paper.

17 Claims, 8 Drawing Sheets

(56) References Cited

U.S. PATENT DOCUMENTS

| | | | | |
|---|---|---|---|---|
| 2001/0025856 | A1* | 10/2001 | Lefevre Du Grosriez | B65H 29/00 221/33 |
| 2006/0231997 | A1* | 10/2006 | Meunier | G06K 1/121 270/52.02 |
| 2015/0128461 | A1* | 5/2015 | Simon | B42D 15/042 493/405 |
| 2015/0306894 | A1* | 10/2015 | Wertheimer | A63H 33/38 281/38 |
| 2019/0075206 | A1* | 3/2019 | Tanigawa | B65H 45/18 |

* cited by examiner

CODE ABSORBING MARKING OF PAPER REAMS

TECHNICAL FIELD

The present disclosure relates to code absorbing marking of paper reams.

BACKGROUND

Reams of paper are a convenient way to store, transport and eventually use paper in photocopiers, computer printers and/or other environments. However, these reams of paper, once the outer paper packaging is removed from the ream, do not include any means that convey information or assist in the use of the paper.

DETAILED DESCRIPTION

In the following description, for purposes of explanation, numerous specific details are set forth in order to provide a thorough understanding of the various aspects of different embodiments of the present invention. It will be evident, however, to one skilled in the art that the present invention may be practiced without all the specific details and/or with variations, permutations, and combinations of the various features and elements described herein.

Figure 1:
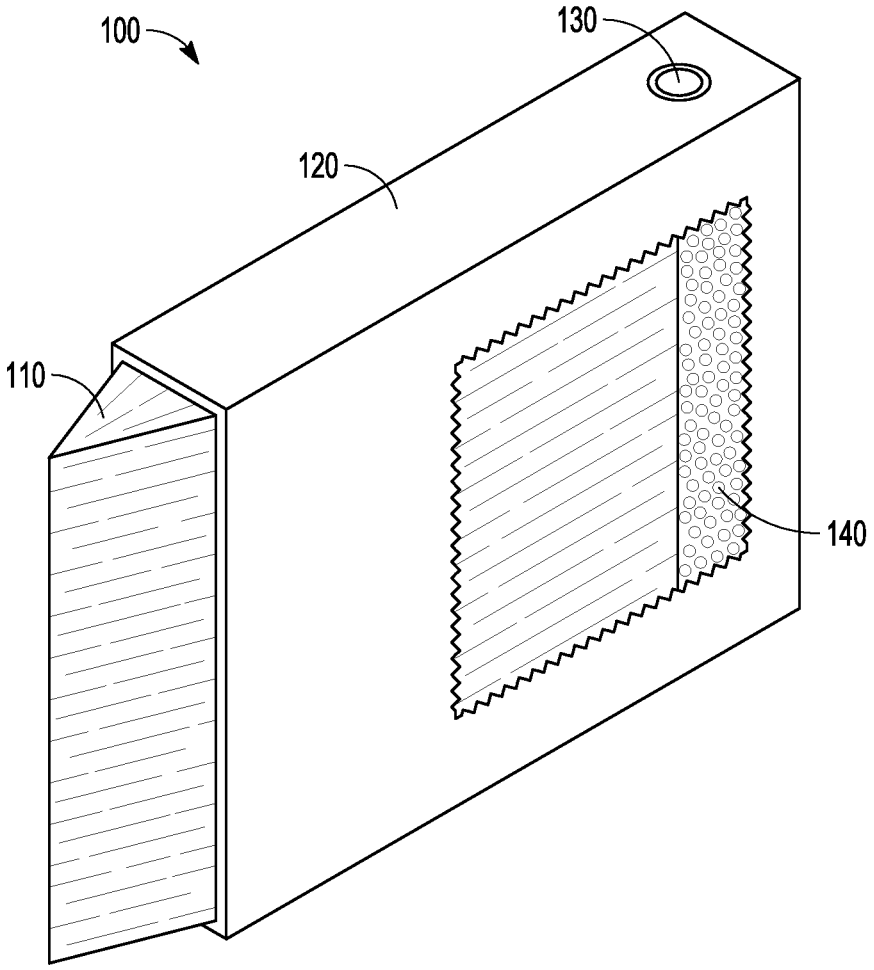
FIG. 1 illustrates an example embodiment of a code absorbing marker for a ream of paper.

FIG. 1 illustrates an example of a code absorbing marker 100. The marker 100 includes a casing 120 and an ink filler opening 130. The ink is contained in an ink reservoir 140, which is within the casing 120. A porous applicator, such as a felt tip marker 110, is coupled to the casing 120. The felt tip marker 110 can also be manufactured out of other materials, such as a sponge-like substance. The porous applicator can also be manufactured out of a plastic or similar material, and include a plurality of openings, through which an ink or similar material can pass from the ink reservoir, through the applicator, to the side of the ream of paper. The felt tip marker 110 or applicator is in communication with the ink reservoir 140. In the embodiment of FIG. 1, the felt tip marker 110 is triangular in shape, but the felt tip marker 110 can also be other shapes such as rounded or elliptical. In an embodiment, the applicator/felt tip marker 110 is sized such that the marking can be applied to the side of the ream of paper in a single operation. That is, the width of the felt tip marker 110 is substantially the same as the width of the paper ream.

Figure 2:
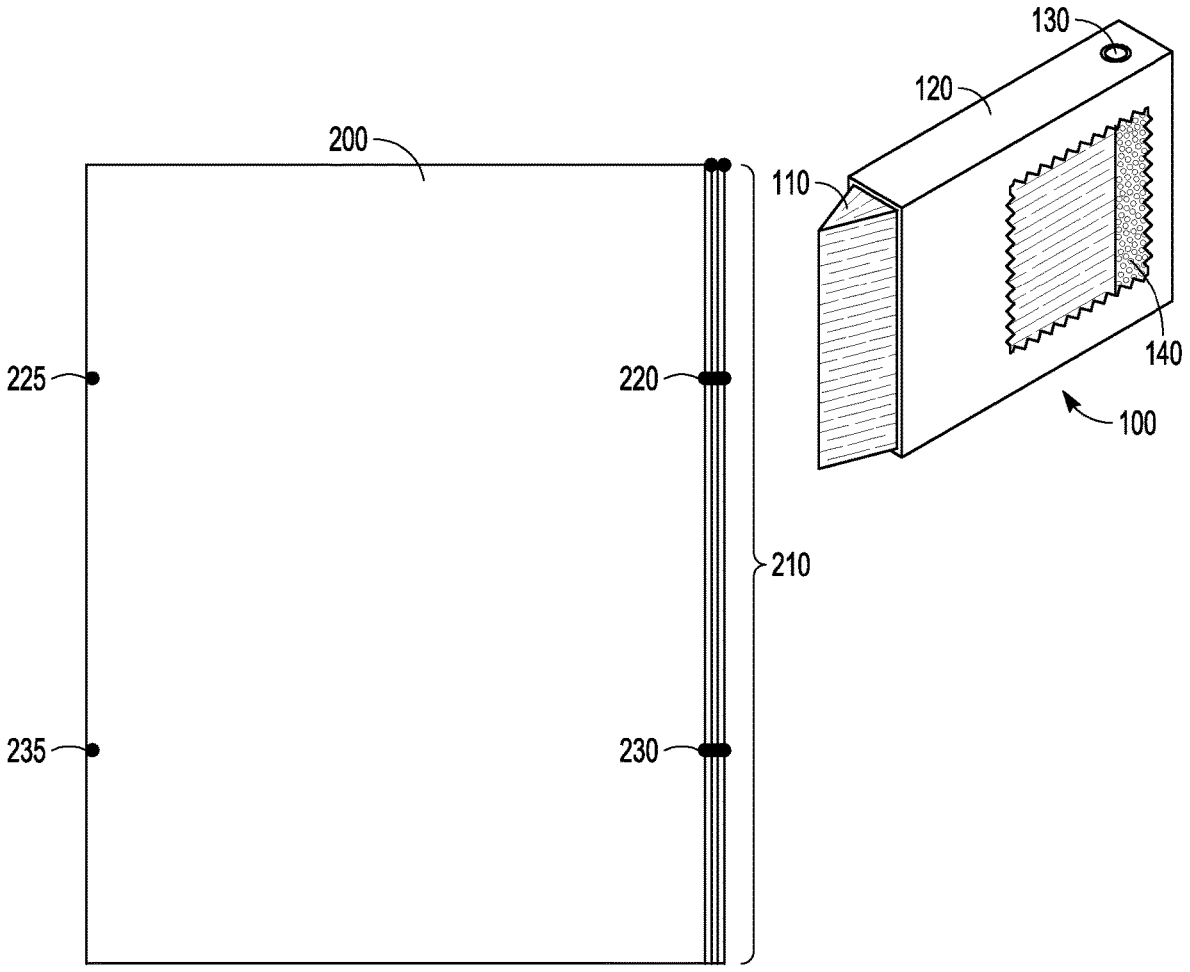
FIG. 2 illustrates an example of using the code absorbing marker of FIG. 1 to apply a coding of, or marking to, a side of a ream of paper.
Figure 3A:
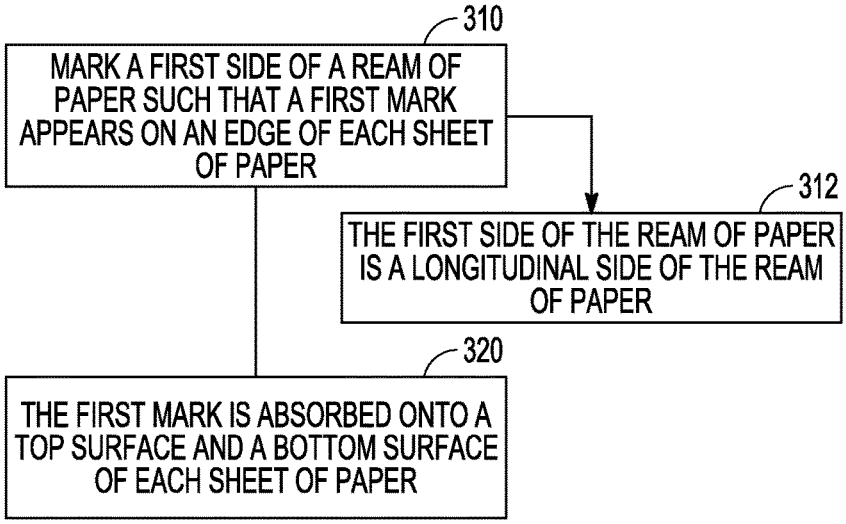
FIGS. 3A, 3B, 3C, 3D, and 3E are block diagrams illustrating example embodiments of operations and features of a code absorbing marking of a ream of paper.
Figure 3B:
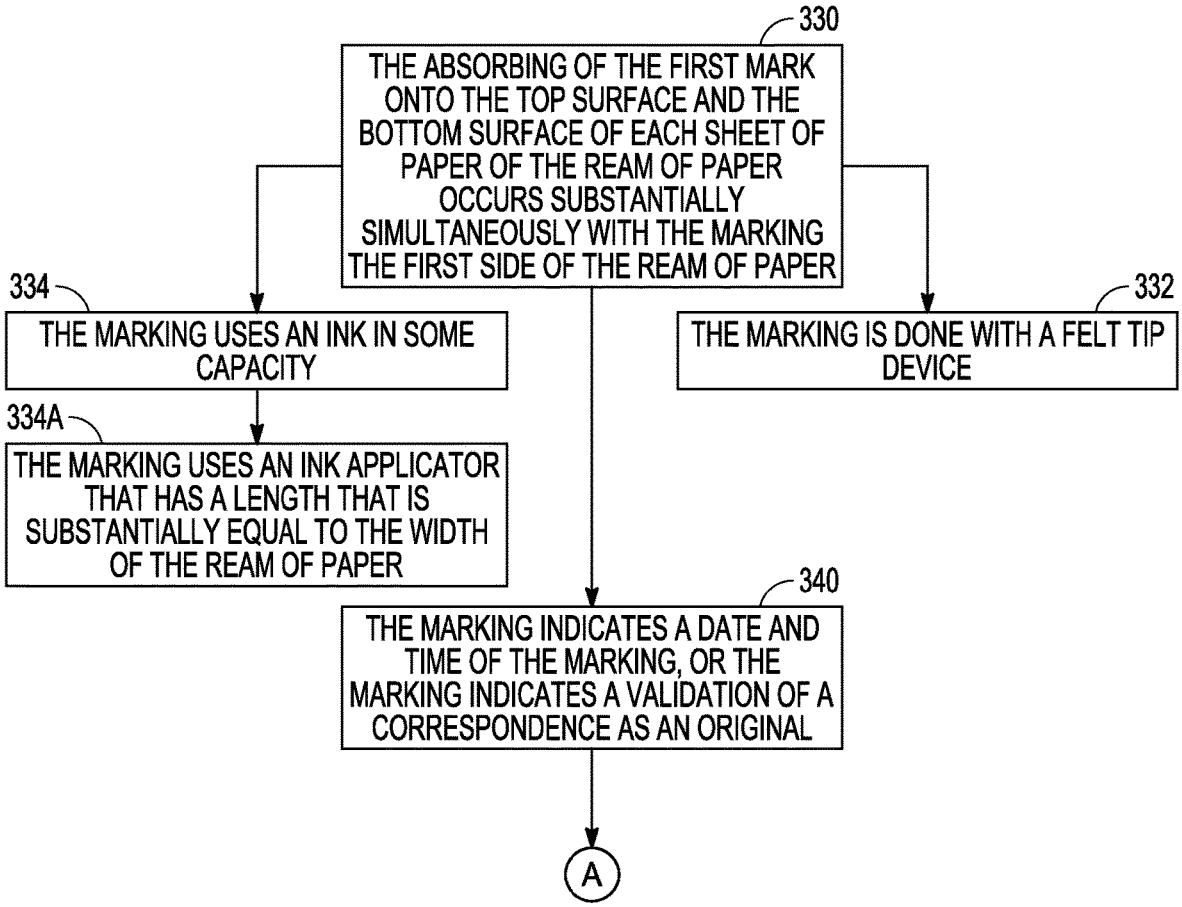
Figure 3C:
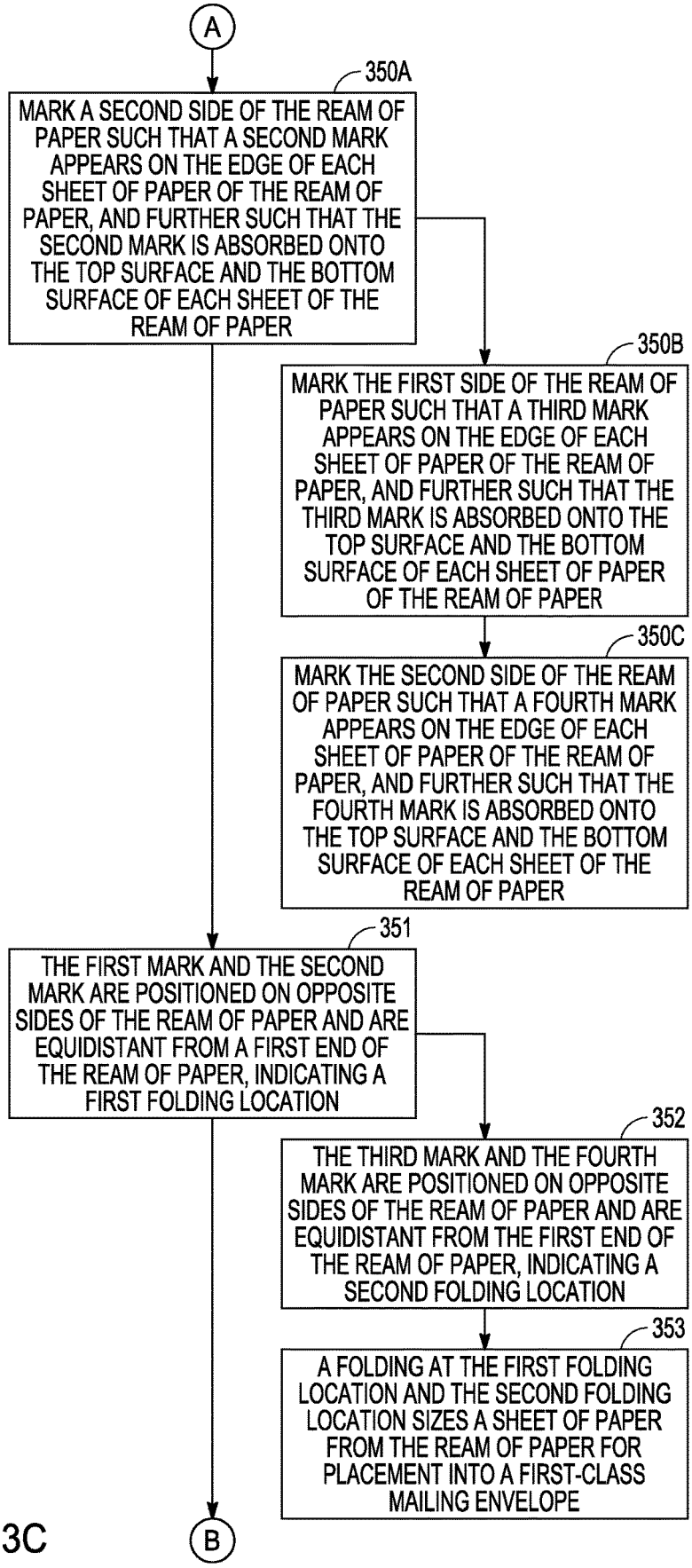
Figure 3D:
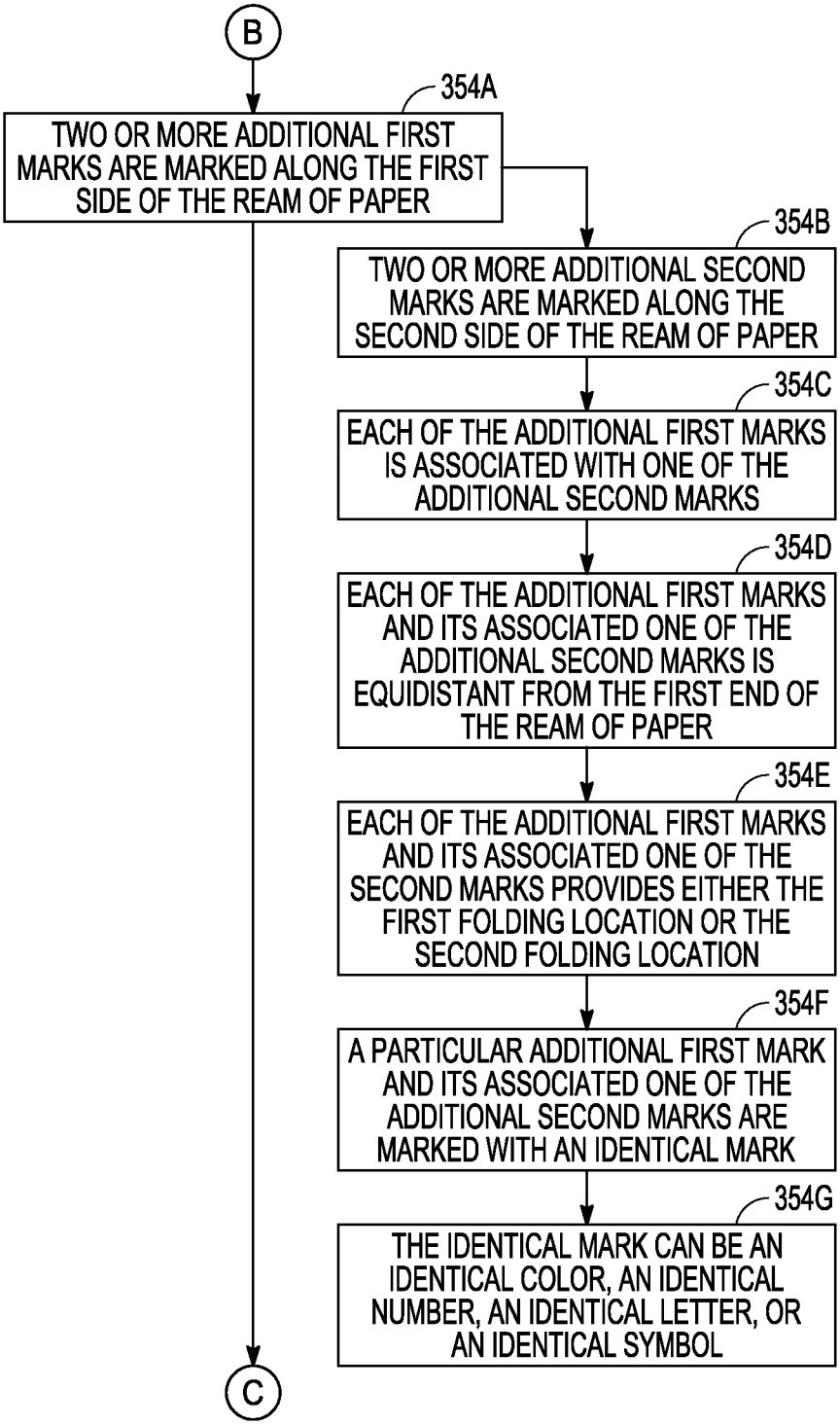
Figure 3E:
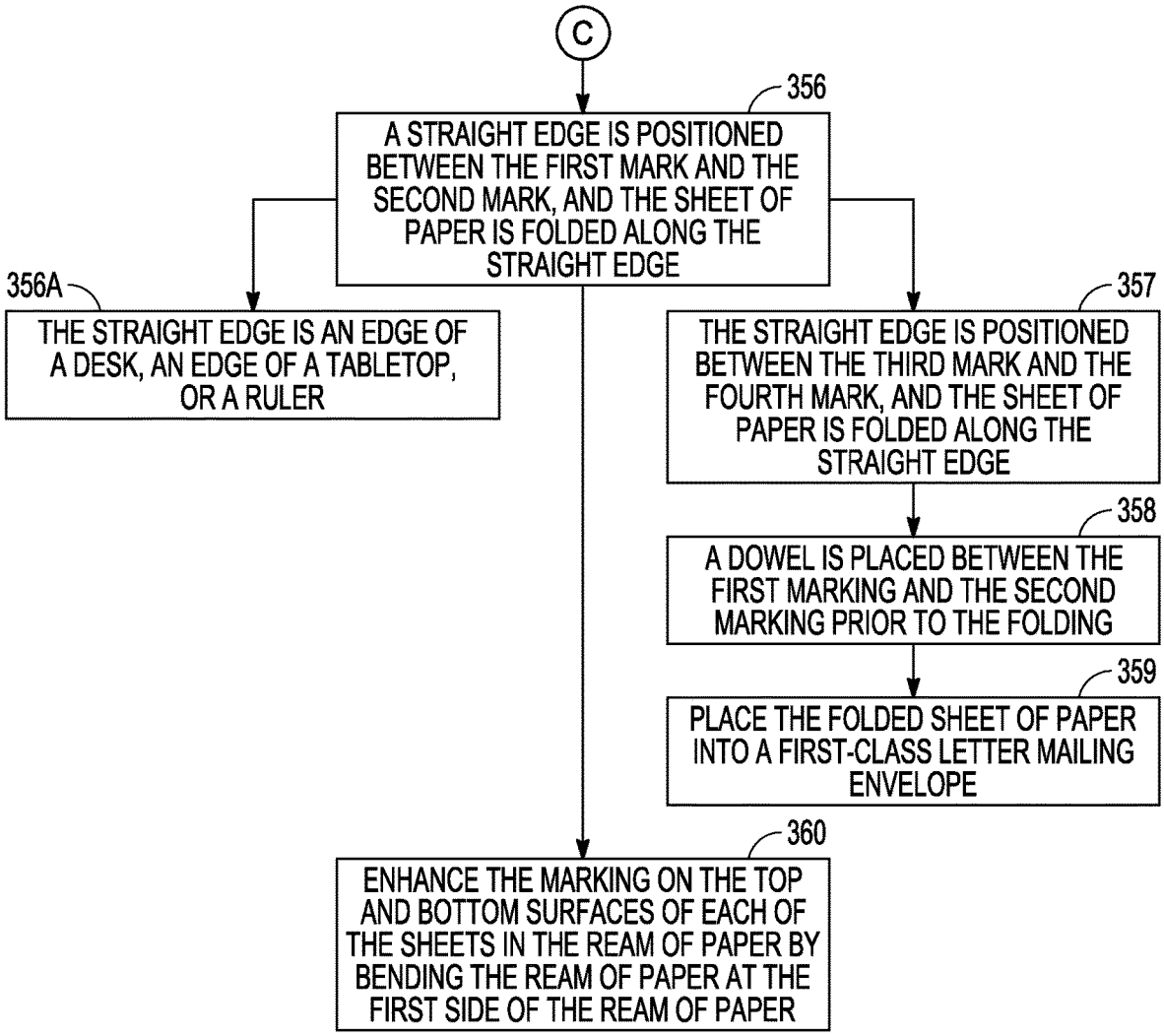

FIG. 2 illustrates an example of using the code absorbing marker 100 of FIG. 1 to apply a marking or coding to a side of a ream of paper 200. The marker 100 is filled with ink, and the ink travels into the applicator or felt tip point 110. The felt tip point 110 is then contacted with a side 210 of a ream of paper 200. This contact can be caused either by a human or automatically by a machine. The contact can be in a single blotting type operation, in a vertical top to bottom motion, or in a horizontal side to side motion. Whatever the application embodiment, the ink marks the edges of the pieces of paper in the ream, and the ink absorbs (or seeps) onto the top and bottom surfaces of each sheet of the ream of paper. As explained in detail in the following paragraphs, the marking and absorbing can serve particular functions and/or convey information.

FIGS. 3A, 3B, 3C, 3D, and 3E are block diagrams illustrating example embodiments of operations and features of a code absorbing marking of a ream of paper. FIGS. 3A, 3B, 3C, 3D, and 3E include a number of process and feature blocks 310-362. Though arranged substantially serially in the example of FIGS. 3A, 3B, 3C, 3D, and 3E, other examples may reorder the blocks, omit one or more blocks, and/or execute two or more blocks in parallel using multiple processors or a single processor organized as two or more virtual machines or sub-processors.

Referring specifically now to FIGS. 3A, 3B, 3C, 3D, and 3E, at 310, a first side of a ream of paper is marked or coded such that a first mark appears on an edge of each sheet of paper of the ream of paper. In an embodiment, as noted above, the code absorbing marker 100 of FIG. 1 can be used for marking or coding the side of the ream of paper. FIG. 2 illustrates an example of how the code absorbing marker 100 can be used to apply a marking to a side of a ream of paper. As indicated at 312, the first side of the ream of paper is a longitudinal side of the ream of paper. This first side orientation is illustrated in FIG. 2 at 210. As indicated at 320, the first mark absorbs onto a top surface and a bottom surface of each sheet of paper of the ream of paper.

FIGS. 3B, 3C, 3D, and 3E make note of several additional embodiments of the present disclosure. At 330, it is noted that the absorbing of the first mark onto the top surface and the bottom surface of each sheet of paper of the ream of paper occurs substantially simultaneously with the marking the first side of the ream of paper. At 332, the marking is done with a felt tip device. For example, the felt tip device can be a simple felt tip marker, such as the felt tip point 110 in FIG. 1. In a related embodiment at 334, the marking uses an ink in some capacity. As noted at 334A, the marking can use the code absorbing marker 100, and the code absorbing marker 100 can include an ink applicator that has a length that is substantially equal to the width of the ream of paper, which permits the marking of the paper in a single operation.

As indicated at 340, the marking indicates a date and time of the marking, or the marking indicates a validation of a correspondence as an original. The date and time of the marking can be determined by the position of the placement of the mark along the side of the paper ream. For example, the one end of the side of the ream of paper can be associated with a particular date and/or time, and the other end of the side of the ream of paper can be associated with another particular date and/or time. Then, the placement of the marking between the two ends can be used to determine a date and/or time. In another embodiment, more than one side of the ream of paper can be used to code the date and/or time, such as using all four sides of the ream of paper to represent a rectangular "clock." The marking can identify a particular piece of correspondence as original because some types of markings, such as a Hi-Liter® marking pen, can be placed on an original document, and the marking will absorb onto the top surface and the bottom surface of each sheet of paper in the ream of paper. However, that Hi-Liter® marking will then not be preserved in the photocopying process because of the Hi-Liter® marking pen contains transparent fluorescent ink, not black or opaque ink like in other felt tip markers. The ingredients in a Hi-Liter® marking pen normally include one or more of Fluorescein, Pyranine, Triphenylmethane, Rhodamine, Xanthene, and Coumarin. While the preferred embodiment is to mark or code the side of a ream of paper, the disclosed techniques in the application to convey information by the position and location of markings on the edge, top and bottom of the paper can be implemented on a single piece of paper by a person or automated process.

In addition to the use of the coding or marking to indicate date and time and/or the validation of correspondence as an original, the coding or marking can be used to assist in the folding of a piece of paper prior to placing the piece of paper in an envelope. For example, at 350A, a second side of the ream of paper is marked such that a second mark appears on the edge of each sheet of paper of the ream of paper, and further such that the second mark absorbs onto the top surface and the bottom surface of each sheet of the ream of paper. Similarly, at 350B, the first side of the ream of paper is marked such that a third mark appears on the edge of each sheet of paper of the ream of paper, and further such that the third mark absorbs onto the top surface and the bottom surface of each sheet of paper of the ream of paper. Likewise, at 350C, the second side of the ream of paper is marked such that a fourth mark appears on the edge of each sheet of paper of the ream of paper, and further such that the fourth mark absorbs onto the top surface and the bottom surface of each sheet of the ream of paper.

These first, second, third, and fourth marks assist in the folding of a sheet of paper as follows. As indicated at 351, the first mark and the second mark are positioned on opposite sides of the ream of paper and are equidistant from a first end of the ream of paper. This is illustrated in FIG. 2 at 220 and 225. And, as indicated at 352, the third mark and the fourth mark are positioned on opposite sides of the ream of paper and are equidistant from the first end of the ream of paper. This is illustrated in FIG. 2 at 230 and 235. The first mark and the second mark indicate a first folding location, and the third mark and the fourth mark indicate a second folding location. As indicated at 353, a folding at the first folding location (220 and 225) and the second folding location (230 and 235) sizes a sheet of paper from the ream of paper for placement into a first-class mailing envelope.

Another embodiment of the folding operations is detailed in operations 354A-354G. At 354A, two or more additional first marks are marked along the first side of the ream of paper, and at 354B, two or more additional second marks are marked along the second side of the ream of paper. As noted at 354C, each of the additional first marks is associated with one of the additional second marks. Each of the additional first marks and its associated one of the additional second marks is equidistant from the first end of the ream of paper (354D), and each of the additional first marks and its associated one of the second marks provides either the first folding location or the second folding location (354E). At 354F, a particular additional first mark and its associated one of the additional second marks are marked with an identical mark. This identical marking makes it easier to line up associated marks in the folding operation. As indicated at 354G, the identical mark can be an identical color, an identical shape, an identical number, an identical letter, or an identical symbol. Such shapes, numbers, letters and symbols can be coded on the side of the ream of paper in a manner similar to the coding of the date and time as discussed above. For example, the coding of a mark at a particular location on the paper can be equated to a particular letter.

Figure 4:
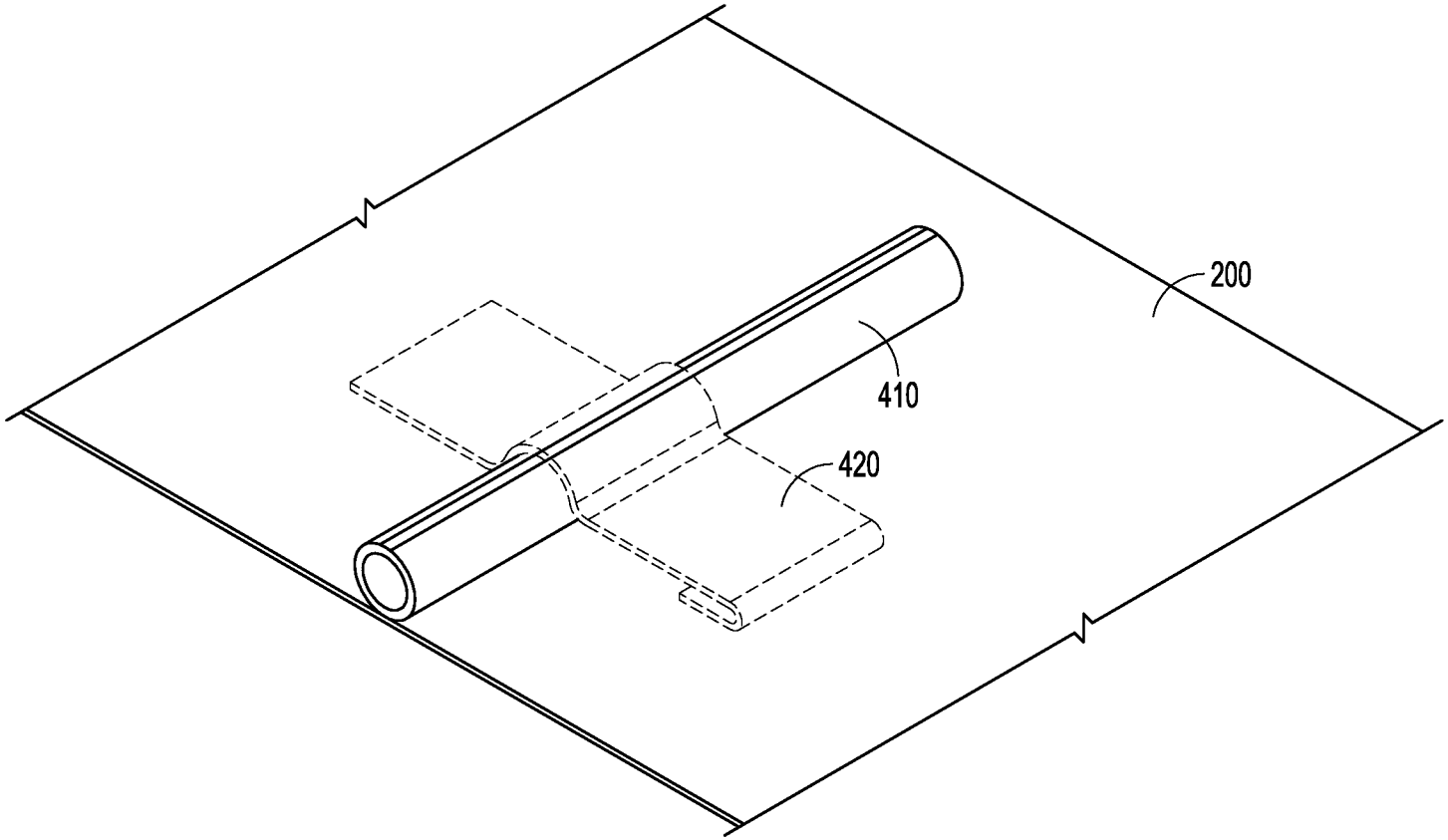
FIG. 4 illustrates an example of using a dowel in a folding operation on a sheet of paper that has been coded or marked using the code absorbing marker of FIG. 1.

The folding of the sheet of paper can be further accomplished as follows. At 356, a straight edge is positioned between the first mark and the second mark, and the sheet of paper is folded along the straight edge. As indicated at 356A, the straight edge can be an edge of a desk, an edge of a tabletop, a ruler, or any other appropriate straight edge surface. Then, at 357, the straight edge is positioned between the third mark and the fourth mark, and the sheet of paper is folded along the straight edge. As indicated at 358, a dowel can be placed between the first marking and the second marking prior to the folding such that the folding does not crease the sheet of paper. FIG. 4 illustrates an example of using a dowel 410 in a folding operation on a sheet of paper. The dowel can be held in place with a piece of tape 420. Thereafter, at 359, the folded sheet of paper, with or without the dowel, can be placed into a first-class letter mailing envelope.

Figure 5:
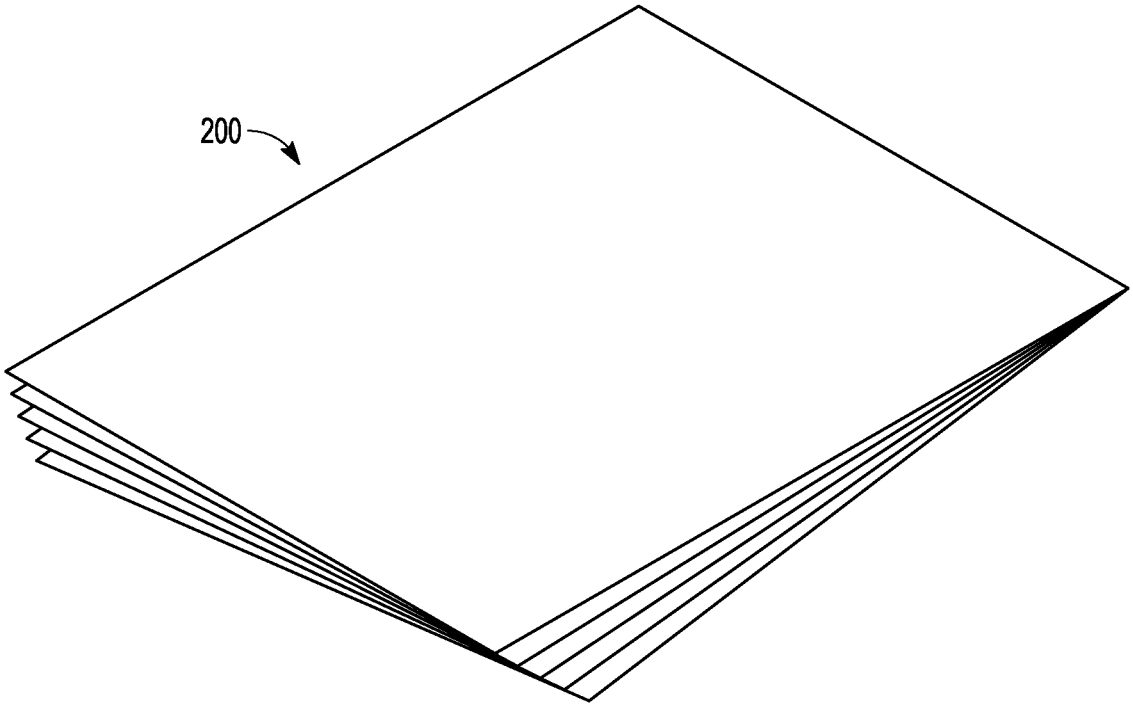
FIG. 5 illustrates a fanning out of a ream of paper.

As noted above, the coding or marking of the edge of the ream of paper results in the absorbing of the marking or ink onto the top and bottom surfaces of each sheet or paper in the ream of paper. In another embodiment, as indicated at 360, the marking on the top and bottom surfaces of each of the sheets in the ream of paper can be enhanced by bending the ream of paper at the first side of the ream of paper before marking the first mark and the third mark, and then bending the ream of paper at the second side of the ream of paper before marking the second mark and the fourth mark. This bending fans out the ream of paper at the first side and the second side, which enhances placement of the first mark, the second mark, the third mark, and the fourth mark on the edge, the top surface, and the bottom surface of each sheet of the ream of paper. This bending and fanning out is illustrated in FIG. 5.

Although embodiments have been described with reference to specific examples, it will be evident that various modifications and changes may be made to these embodiments without departing from the broader spirit and scope of the invention. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

EXAMPLES

Example No. 1 is a process including marking a first side of a ream of paper such that a first mark appears on an edge of each sheet of paper of the ream of paper, and such that the first mark absorbs onto a top surface and a bottom surface of each sheet of paper of the ream of paper.

Example No. 2 includes all the features of Example No. 1, and optionally includes a process wherein the absorbing of the first mark onto the top surface and the bottom surface of each sheet of paper of the ream of paper occurs substantially simultaneously with the marking the first side of the ream of paper.

Example No. 3 includes all the features of Example Nos. 1-2, and optionally includes a process wherein the marking comprises use of a felt tip device.

Example No. 4 includes all the features of Example Nos. 1-3, and optionally includes a process wherein the marking comprises use of an ink.

Example No. 5 includes all the features of Example Nos. 1-4, and optionally includes a process wherein the ink comprises a transparent fluorescent ink.

Example No. 6 includes all the features of Example Nos. 1-5, and optionally includes a process wherein the marking comprises use of an ink applicator comprising a length substantially equal to a width of the ream of paper.

Example No. 7 includes all the features of Example Nos. 1-6, and optionally includes a process wherein the marking comprises an indication of a date and time of the marking or a validation of a correspondence as an original.

Example No. 8 includes all the features of Example Nos. 1-7, and optionally includes a process including marking a second side of the ream of paper such that a second mark appears on the edge of each sheet of paper of the ream of paper, and such that the second mark absorbs onto the top surface and the bottom surface of each sheet of the ream of paper; marking the first side of the ream of paper such that a third mark appears on the edge of each sheet of paper of the ream of paper, and such that the third mark absorbs onto the top surface and the bottom surface of each sheet of paper of the ream of paper; and marking the second side of the ream of paper such that a fourth mark appears on the edge of each sheet of paper of the ream of paper, and such that the fourth mark absorbs onto the top surface and the bottom surface of each sheet of the ream of paper; wherein the first mark and the second mark are positioned on opposite sides of the ream of paper and equidistant from a first end of the ream of paper; wherein the third mark and the fourth mark are positioned on opposite sides of the ream of paper and equidistant from the first end of the ream of paper; wherein the first mark and the second mark indicate a first folding location; and wherein the third mark and the fourth mark indicate a second folding location.

Example No. 9 includes all the features of Example Nos. 1-8, and optionally includes a process wherein a folding at the first folding location and the second folding location sizes a sheet of paper from the ream of paper for placement into a first-class mailing envelope.

Example No. 10 includes all the features of Example Nos. 1-9, and optionally includes a process including selecting a sheet of paper from the ream of paper; positioning a straight edge between the first mark and the second mark; folding the sheet of paper along the straight edge; positioning the straight edge between the third mark and the fourth mark; folding the sheet of paper along the straight edge; and placing the folded sheet of paper into the first-class mailing envelope.

Example No. 11 includes all the features of Example Nos. 1-10, and optionally includes a process wherein the straight edge comprises an edge of a desk, an edge of a tabletop, or a ruler.

Example No. 12 includes all the features of Example Nos. 1-11, and optionally includes a process including placing a dowel between the first marking and the second marking prior to the folding such that the folding does not crease the sheet of paper.

Example No. 13 includes all the features of Example Nos. 1-12, and optionally includes a process wherein the first side of the ream of paper and the second side of the ream of paper comprise longitudinal sides of the ream of paper.

Example No. 14 includes all the features of Example Nos. 1-13, and optionally includes a process including bending the ream of paper at the first side of the ream of paper before marking the first mark and the third mark, and bending the ream of paper at the second side of the ream of paper before marking the second mark and the fourth mark, thereby fanning out the ream of paper at the first side and the second side, thereby enhancing placement of the first mark, the second mark, the third mark, and the fourth mark on the edge, the top surface, and the bottom surface of each sheet of the ream of paper.

Example No. 15 includes all the features of Example Nos. 1-14, and optionally includes a process including marking a plurality of additional first marks along the first side of the ream of paper; and marking a plurality of additional second marks along the second side of the ream of paper; wherein each of the additional first marks is associated with one of the additional second marks; wherein each of the additional first marks and its associated one of the additional second marks is equidistant from the first end of the ream of paper; and wherein each of the additional first marks and its associated one of the second marks provides either the first folding location or the second folding location.

Example No. 16 includes all the features of Example Nos. 1-15, and optionally includes a process including marking a particular additional first mark and its associated one of the additional second marks with an identical mark, thereby making it easier to line up associated marks.

Example No. 17 includes all the features of Example Nos. 1-16, and optionally includes a process wherein the identical mark comprises an identical color, an identical number, an identical letter, or an identical symbol.

Example No. 18 is an apparatus for applying a marking to a side of a ream of paper including a casing comprising an ink reservoir and an ink filler opening; and a porous applicator coupled to the casing; wherein the applicator is sized such that the marking can be applied to the side of the ream of paper in a single operation.

Example No. 19 includes all the features of Example No. 18 and optionally includes an apparatus for applying a marking to a side of a ream of paper wherein the porous applicator is triangular.

Example No. 20 includes all the features of Example Nos. 18-19 and optionally includes an apparatus for applying a marking to a side of a ream of paper wherein the porous applicator comprises a felt tip.

Example No. 21 includes all the features of Example Nos. 18-20 and optionally includes an apparatus for applying a marking to a side of a ream of paper wherein the porous applicator comprises a plurality of openings, thereby permitting passage of ink from the ink reservoir to the side of the ream of paper.

Example No. 22 includes all the features of Example Nos. 18-21 and optionally includes an apparatus for applying a marking to a side of a ream of paper wherein the marking to the side of the ream of paper causes the marking to substantially simultaneously absorb onto a top surface and a bottom surface of each sheet of paper of the ream of paper.

Example No. 23 is a process including absorbing transfer marking of a ream of paper such that the first mark appears on an edge of each sheet of paper of the ream of paper, and such that the first mark absorbs into a top surface and a bottom surface of each sheet of paper of the ream of paper.

The invention claimed is:

1. A process comprising:

A marking a first side of a ream of paper along a width or thickness of the ream of paper, wherein a first mark appears along the width or thickness of the ream of paper and on an edge of each sheet of paper of the ream of paper, and the first mark is absorbed from the edge of each sheet of paper in the ream of paper onto a top surface and a bottom surface of each sheet of paper of the ream of paper.

2. The process of claim 1, wherein the absorbing of the first mark onto the top surface and the bottom surface of each sheet of paper of the ream of paper occurs substantially simultaneously with the marking the first side of the ream of paper.

3. The process of claim 1, wherein the marking comprises use of a felt tip device.

4. The process of claim 1, wherein the marking comprises use of an ink.

5. The process of claim 4, wherein the ink comprises a transparent fluorescent ink.

6. The process of claim 4, wherein the marking comprises use of an ink applicator or a felt tip device comprising a length substantially equal to a width of the ream of paper.

7. The process of claim 1, wherein the marking comprises an indication of a date and time of the marking or a validation of a correspondence as an original.

8. The process of claim 1, comprising:

marking a second side of the ream of paper such that a second mark appears on the edge of each sheet of paper of the ream of paper, and such that the second mark absorbs onto the top surface and the bottom surface of each sheet of the ream of paper;

marking the first side of the ream of paper such that a third mark appears on the edge of each sheet of paper of the ream of paper, and such that the third mark absorbs onto the top surface and the bottom surface of each sheet of paper of the ream of paper; and marking the second side of the ream of paper such that a fourth mark appears on the edge of each sheet of paper of the ream of paper, and such that the fourth mark absorbs onto the top surface and the bottom surface of each sheet of the ream of paper;

wherein the first mark and the second mark are positioned on opposite sides of the ream of paper and equidistant from a first end of the ream of paper;

wherein the third mark and the fourth mark are positioned on opposite sides of the ream of paper and equidistant from the first end of the ream of paper;

wherein the first mark and the second mark indicate a first folding location; and wherein the third mark and the fourth mark indicate a second folding location.

9. The process of claim 8, wherein a folding at the first folding location and the second folding location sizes a sheet of paper from the ream of paper for placement into a first-class mailing envelope.

10. The process of claim 9, comprising:

selecting a sheet of paper from the ream of paper;

positioning a straight edge between the first mark and the second mark;

folding the sheet of paper along the straight edge;

positioning the straight edge between the third mark and the fourth mark;

folding the sheet of paper along the straight edge; and placing the folded sheet of paper into the first-class mailing envelope.

11. The process of claim 10, wherein the straight edge comprises an edge of a desk, an edge of a tabletop, or a ruler.

12. The process of claim 9, comprising placing a dowel between the first marking and the second marking prior to the folding such that the folding does not crease the sheet of paper.

13. The process of claim 1, wherein the first side of the ream of paper and the second side of the ream of paper comprise longitudinal sides of the ream of paper.

14. The process of claim 1, comprising bending the ream of paper at the first side of the ream of paper before marking the first mark and a third mark on the first side of the ream of paper, and bending the ream of paper at a second side of the ream of paper opposite the first side before marking a second mark and a fourth mark on the second side of the ream of paper, thereby fanning out the ream of paper at the first side and the second side, thereby enhancing placement of the first mark, the second mark, the third mark, and the fourth mark on the edge, the top surface, and the bottom surface of each sheet of the ream of paper.

15. The process of claim 1, comprising:

marking a plurality of additional first marks along the first side of the ream of paper; and marking a plurality of additional second marks along the second side of the ream of paper;

wherein each of the additional first marks is associated with one of the additional second marks;

wherein each of the additional first marks and its associated one of the additional second marks is equidistant from the first end of the ream of paper; and wherein each of the additional first marks and its associated one of the second marks provides either the first folding location or the second folding location.

16. The process of claim 15, comprising marking a particular additional first mark and its associated one of the additional second marks with an identical mark.

17. The process of claim 16, wherein the identical mark comprises an identical color, an identical number, an identical letter, or an identical symbol.

* * * * *